United States Patent [19]

Van Biesen et al.

[11] Patent Number: 4,879,196

[45] Date of Patent: Nov. 7, 1989

[54] ELECTROPHOTOGRAPHIC METHOD FOR REVERSAL OR POSITIVE-POSITIVE IMAGE FORMATION

[75] Inventors: Jozef A. Van Biesen, Boechout; Guido F. Daes, Boom; Jan B. Verstringe, Mortsel, all of Belgium

[73] Assignee: Agfa-Gevaert N.V., Mortsel, Belgium

[21] Appl. No.: 63,467

[22] Filed: Jun. 18, 1987

[30] Foreign Application Priority Data

Jul. 1, 1986 [EP] European Pat. Off. ..... 86201151.7

[51] Int. Cl.[4] ..... G03G 13/22

[52] U.S. Cl. ..... 430/100; 430/31

[58] Field of Search ..... 430/31, 100

[56] References Cited

FOREIGN PATENT DOCUMENTS

| | | | |
|---|---|---|---|
| 250947 | 7/1963 | Australia | 430/31 |
| 2010374 | 6/1968 | France | 430/31 |
| 38-17246 | 6/1963 | Japan | 430/31 |
| 42-34 | 1/1967 | Japan | 430/31 |
| 45-14513 | 5/1970 | Japan | 430/31 |
| 47-26905 | 7/1972 | Japan | 430/100 |

*Primary Examiner*—Roland E. Martin

*Attorney, Agent, or Firm*—William J. Daniel

[57] ABSTRACT

An electrophotographic copying method for optionally producing either reversal or positive-positive copies from any original using the same photoconductive element and the same toner developing material by varying the exposure and electrostatic charging conditions.

6 Claims, 5 Drawing Sheets

ELECTROPHOTOGRAPHIC METHOD FOR REVERSAL OR POSITIVE-POSITIVE IMAGE FORMATION

DESCRIPTION

The present invention relates to the production and development of electrostatic images using photoconductive recording material and electrically charged toner particles. The invention also relates to electrophotographic recording apparatus.

Electrophotographic copying processes are known whereby developed images which are in positive-positive relationship or reversal relationship to a graphic original can be obtained using a given photoconductive recording material.

The more usual electrophotographic copying procedure produces a positive copy of a positive original by the following steps :

(i) uniformly electrostatically charging a photoconductive layer by means of a corona-discharge, (ii) image-wise exposing said photoconductive layer to electromagnetic radiation to which it is sensitive, and (iii) applying electrostatically charged toner particles to develop the resulting electrostatic charge pattern.

The toner pattern or image resulting from step (iii) is in some copying processes transferred from the photoconductive layer to a receptor material on which the toner transfer image is then fixed or adhered.

In the foregoing procedure the toner particles have to be of opposite charge sign to the charges conferred on the photoconductive layer by step (i) so that the particles are attracted to those areas of the layer which retain charges following its image-wise exposure (step ii).

In the known procedures for producing developed reversal copies, a photoconductive element is uniformly electrostatically charged and image-wise exposed and toner particles are used for developing charges which are induced in the areas exposed in the image-wise exposure step. Those induced charges are of opposite sign to the original charges retained in the non-exposed areas. The induced charges may exist due to the fringe effect at the surface of the photoconductive layer near the edges of the exposed areas.

Alternatively charges can be induced in the exposed areas by using a magnetic brush toner-applicator to which a bias voltage of the same sign as the retained charges is applied so that it serves through the agency of conductive carrier particles of the developer material to induce the necessary charges of opposite sign in the exposed areas (ref. R. M. Schaffert "Electrophotography" The Focal Press—London, New, York, enlarged and revised edition, 1975, pp. 50–51 and T. P. Maclean "Electronic Imaging" Academic Press—London, 1979, p. 213). In either case it is necessary to use toner particles bearing electrostatic charges of opposite polarity to those which would be required in the case of a toner for use in a positive-positive copying procedure using a common photoconductive element, i.e., either the same element or an element comprising photoconductive material of the same type (n- or p-type).

The present invention provides an electrophotographic reversal copying method which utilises toner particles bearing electrostatic charges of opposite sign to the charges conferred on the photoconductive layer prior to its image-wise exposure. The toner particles used for this development can therefore be derived from a supply which can also be used in positive-positive reproduction using the same or the same type of photoconductive layer.

According to the present invention there is provided an electrophotographic reversal copying method utilising a recording element comprising a photoconductive layer and developer material comprising electrostatically charged toner particles, characterised in that the method comprises the following steps :

(I) uniformly exposing the photoconductive element to light in the photosensitivity range of the photoconductive layer, which means in a range below the range wherein the ratio of the decrease in optical density ($\Delta D$) of the photoconductive layer with respect to wavelength increment ($\Delta\lambda$ in nm) is at least 0.02, i.e. [$\Delta D/\Delta\lambda$(nm)=at least 0.021], (II) uniformly electrostatically charging the layer by means of a corona discharge, (III) image-wise exposing the layer to light of a wavelength shorter, preferably 100 nm shorter, than the wavelength of the light used in step (i), (IV) repeating step (I), (V) repeating step (II), the doses and wavelength difference of the light to which the layer is exposed in steps (I) and (III) being such that this step (V) results in a condition in which areas of the layer which were exposed in step (III) bear electrostatic charges greater than charges borne by areas which were not exposed in that step; and (VI) developing the image formed by the distribution pattern of those greater charges by means of electrostatically charged toner particles of opposite sign to those charges.

As already indicated this method affords the advantage that the charge sign of the toner particles used in the development step is the same as that which toner particles must have for common positive-positive reproduction work using a photoconductive layer of the same composition. Consequently reprographers can produce both positive-positive and reversal copies by means of the same or the same type of photoconductive recording element without having to switch from one type of developer material to another.

When using a method according to the invention the gradation of the latent image can be controlled by the wavelength of the light used in the image-wise exposure step.

The method according to the invention relies partly upon the phenomenon known as "fatigue" which occurs in a photoconductive element and is dependent on wavelength of the irradiating light and depth of penetration of light into the photoconductive element.

Fatigue in a photoconductive element manifests itself as an increase in the rate of dark decay of the surface potential with repeated charging and exposure. According to R. M. Schaffert in the book "Electrophotography", p.67, fatigue in amorphous selenium is caused by the build up within the photoconductive film of trapped charges which produce a high field condition at the interface between the photoconductive layer and its conductive substrate. These internally trapped charges also produce a change in the surface potential.

The ratio $\Delta D/\Delta\lambda$ being at least 0.02 describes a phenomenon known to those skilled in the art under the name "absorption edge". For example, in a wavelength increment of 100 nm the optical density (D) decreases by at least 2.0.

The notion "absorption edge" relates according to Ralph A. Zingaro and W. Charles Cooper in the book : "Selenium"—Van Nostrand Reinhold Company—New York (1974) p.191 and 197–203 to a relative sharp jump in the ratio of absorption coefficient.$cm^{-1}$ to photon energy (eV) and is illustrated in that book for selenium.

The conversion of photon energy in eV to wavelength in nm, and the conversion of absorption coefficient.$cm^{-1}$ in optical density (D) is known to those skilled in the art.

Information about "absorption edge" with regard to semiconductors in general is given under the wording "Absorption" and "Absorptionskante" in Lexikon der Physik, Band 1: A–H, Keller & Co., Stuttgart (1969), p. 15–18.

In carrying out the invention it is preferred to use a photoconductive element which has a fatigue characteristic that manifests itself in an absolute drop in chargeability (voltage level) of at least 100V and a percentage drop of at least 25% when the element is subjected to the following test :

Test : The photoconductive element is subjected to successive cycles of overall exposure and overall corona charging. The overall exposure in each cycle is an exposure to an incandescent lamp provided with a cut-off filter transmitting light above 694 nm, the exposure dose corresponding with 900 mJ/m2. The overall charging is effected by means of corona current of 6.5 $\mu$A/cm and gives at the start of each cycle a surface charge of $4.10^7$ C/cm2. The difference between the surface charges on the photoconductive element, expressed in volts, obtained in the first and in the tenth cycle respectively is a measure of the voltage drop and consequently of the fatigue.

In a particularly preferred embodiment of the invention, use is made of a photoconductive element which under the foregoing test has a voltage level of 1250 obtained in the first cycle and only 350V obtained in the tenth cycle.

The photoconductive substance of the recording element used in a method according to the invention can be of inorganic or organic nature. For example, the photoconductive substance can be selenium or an alloy thereof.

The method according to the invention is particularly suited for making reversal copies of graphic originals by means of a cyclically functioning machine for copying different originals in succession by means of a photoconductive element from which image-wise deposited toner becomes transferred to receptor material and the element is cleaned for use in a following copying cycle. Such machines as presently used conventionally include cleaning, charging, image-wise exposure, development and transfer stations through which the photoconductive element progressively moves in each copying cycle. By providing a machine which includes first and second charging stations appropriate for performing steps (II) and (IV) of a method according to the invention, with exposure stations appropriate for performing steps (I) and (III), and with means whereby for eliminating steps (IV) and (V) at will, both positive-positive and reversal copying work can be performed by means of the same machine having the same photoconductive element using developer material of the same type, even from the same batch.

The invention includes an electrophotographic copying method wherein different copies are formed by reversal and positive-positive copying procedures at different periods of time using in both procedures the same photoconductive recording material or photoconductive recording materials of the same (n- or p-type) and using in each procedure a developer material comprising toner particles bearing electrostatic charges of the same sign as the toner particles of the developer material used in the other procedure, the reversal copying procedure comprising the steps recited in claim 1 and the positive-positive copying procedure comprising the steps of:

(1) uniformly photo-exposing the photoconductive recording material, (2) uniformly charging the recording material by means of a corona discharge, (3) image-wise exposing the charged recording material to leave a latent electrostatic image formed by the residual charges; and (4) developing the latent electrostatic images by means of developer material comprising toner particles bearing electrostatic charges of opposite sign to the residual charges forming said latent image.

The use of fatigue and the effect of light of different wavelengths on the charge level in the exposed and non-exposed areas of a photoconductive coating is illustrated by means of the accompanying drawings.

FIG. 1 represents a schematic cross-sectional drawing of a photoconductive recording drum provided in successive order with a pre-exposure station for uniform exposure, a corona-charging station, an exposure station for information-wise exposure, a station for a second uniform exposure, a second corona station and a measuring station for determining the charge level on the photoconductive coating of the drum.

FIG. 2 represents curves of charge level variation between the areas of the photoconductve element that have been subjected to a succession of cycles, wherein in 13 successive cycles the first 8 cycles are free from image-wise exposure, the following 5 cycles include an image-wise exposure and the next 8 cycles are again free from the image-wise exposure, said cycles proceeding in the reversal mode as explained in connection with FIG. 1 furtheron.

Figure 1:
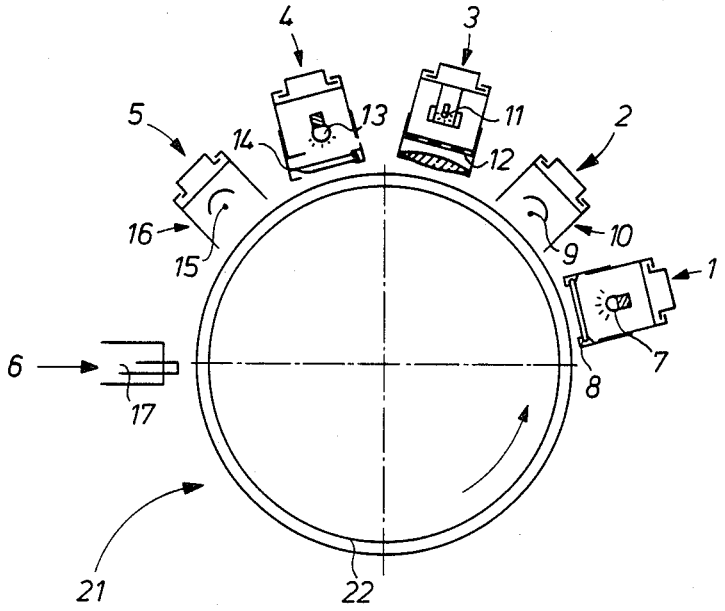

More particularly, FIG. 1 illustrates how the image-reversal of the latent electrostatic image is obtained in practice.

In FIG. 1 element 21 is a rotatable aluminium drum coated with a vacuum-deposited photoconductive layer 22 of arsenic triselenide ($As_2Se_3$). The drum is rotated in the indicated direction toward working stations 1, 2, 3, 4 and 5 and measuring station 6.

At station 1 the photoconductive layer is uniformly exposed with light of a lamp 7 projecting light through filter 8 in order to expose the photoconductive layer 22 with light of wavelengths larger than 650 nm.

At station 2 the photoconductive layer 22 is submitted to a positive corona charge with corona wires 9 of corona charging device 10 hereby positively charging a photoconductor that is of the p-type. An n-type photoconductor will require a negative charging.

At station 3 the photoconductive layer 22 is information-wise exposed with exposure source 11 through an original 12. The wavelength of the light used in the information-wise exposure is shorter than of the light used in the above uniform exposure. The optimal exposure dose of said information-wise exposure is selected as a in function of the intensity of the pre-exposure and charge level of the photoconductive layer. The exposure intensity may vary, e.g. in the range of 1 to 20 mJ/m2.

At station 4 the photoconductive layer is re-exposed uniformly with lamp 13 projecting light through filter 14 of the same spectral composition as used in the first station, but not necessarily with the same intensity.

At station 5 the photoconductive layer is subjected to the charging of corona charging wires 15 of corona charging device 16, the charging being of the same polarity as applied at station 2.

Figure 2:
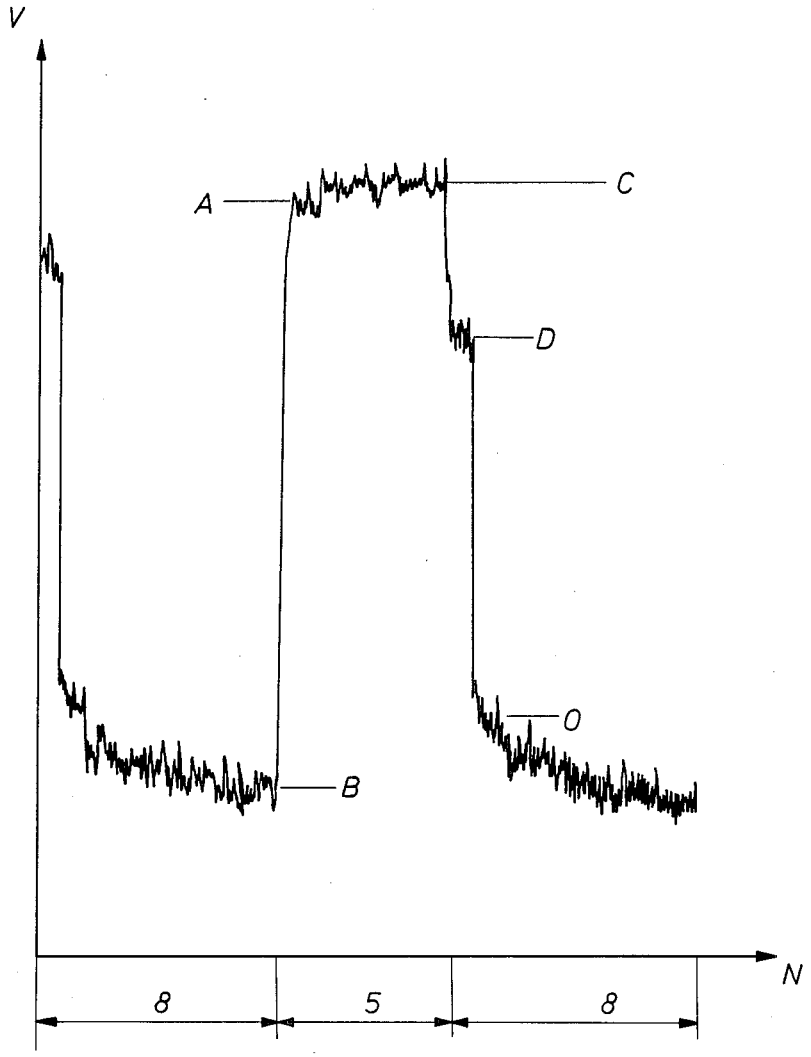

At station 6 the charge level, obtained on the photoconductive layer in the information-wise exposed and in the non-exposed areas of the information-wise exposure are measured with a measuring device 17 yielding charge level curves of the type shown in FIG. 2.

Development with negatively charged toner particles of the photoconductive layer that had been subjected to the above operations yielded a reversal image with respect to the original.

FIG. 2 represents curves of charge level variation between the areas of the photoconductive element that have been subjected to a succession of cycles, wherein in 13 successive cycles the first 8 cycles are free from image-wise exposure, the following 5 cycles include an image-wise exposure and the next 8 cycles are again free from the image-wise exposure, said cycles proceeding in the reversal mode as explained in connection with FIG. 1 above.

In said curves the charge level (V) expressed in volts is represented in the ordinate and the number (N) of copying cycles is represented in the abscis.

Figure 3:
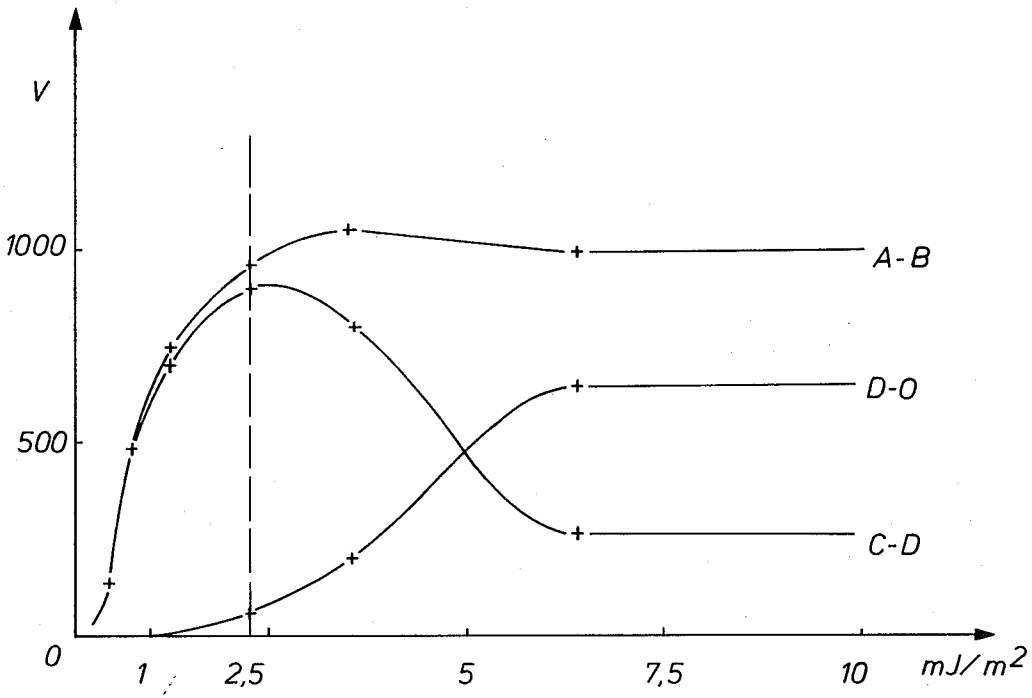
FIG. 3 represents the evolution of potential differences between information-wise and non-information-wise exposed areas, so-called contrast potentials, obtained in reversal mode on carrying out the information-wise exposure at wavelength 550 nm and using increasing light-doses.

The switching of the reversal mode procedure from image-wise exposure to non-image-exposure of the photoconductive element gives rise to a rest potential expressed in said curves by the distance between D and 0 (D−O). In the ideal situation that distance would be zero, i.e. A−B would be equal to C−D. A residual D−O potential difference gives rise to so-called ghost images. A very close approximation to the ideal situation can be obtained by adjusting the information-wise exposure dose. Such is illustrated in FIG. 3.

The distance A−B corresponds with a difference in potential (contrast potential) measured in an area of the photoconductive element that in a previous procedure had been subjected to the steps (I), (II), (IV) and (V), and subsequently to the procedure comprising the steps (I), (II), (III), (IV) and (V).

The distance C−D corresponds with a difference in potential (contrast potential) measured in an area of the photoconductive element that in a previous procedure has been subjected to the steps (I), (II), (III), (IV) and (V), and subsequently to the procedure comprising the steps (I), (II), (IV) and (V).

The contrast voltage variations are measured under conditions wherein a corona voltage of 7 kV is applied on corona wires 9 and 15 respectively and a same uniform exposure dose of 800 mJ/m2 is applied at stations 1 and 4. When using an information-wise applied exposure dose smaller than 2.5 mJ/m2 with light of wavelength 530 nm (green light), the contrast potentials A−B and C−D are the same. Under these conditions a practically zero D−O potential difference is obtained so that ghost image formation is practically nil.

Under the given conditions an optimal information-wise exposure dose of 2.5 mJ/m2 yields a maximal value of the contrast potential of 800 volt with respect to zero exposure dose in the information-wise exposure.

Figure 4:
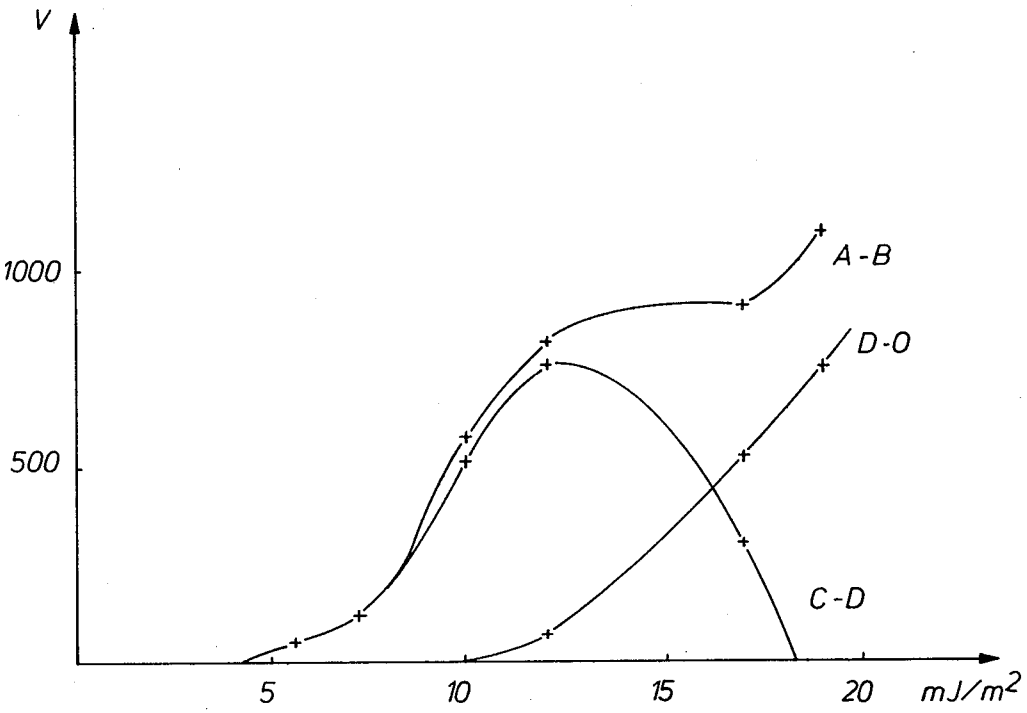
FIG. 4 represents the evolution of potential differences between information-wise and non-information-wise exposed areas, so-called contrast potentials, obtained in reversal mode on carrying out the information-wise exposure at wavelength 390 nm and using increasing light-doses.

In FIG. 4 analogous results are illustrated when using blue light (430 nm) in the information-wise exposure. Under said conditions an optimal information-wise exposure dose of 12 mJ/m2 yields a maximal value of the contrast potential of 800 volt with respect to zero exposure dose in the information-wise exposure.

Figure 5:
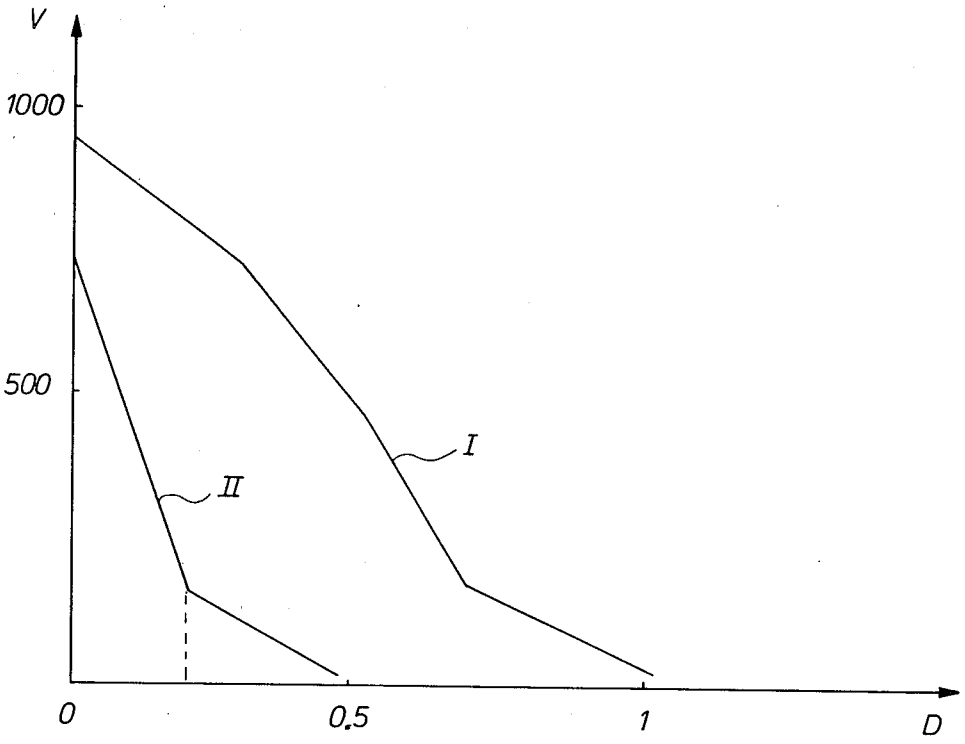
FIG. 5 represents the evolution of the contrast potentials operating in the reversal mode as a function of optical density of the original when using respectively green and blue light in the image-wise exposure.

In FIG. 5 curves I and 11 are given wherein contrast potential difference (volt) in the ordinate is set against optical density (D) of the original in the abscis. From curve II can be learned that on using blue light (380 nm) in the image-wise exposure a contrast potential difference of 600V is obtained over an optical density difference of 0.2 in the original, whereas as shown by curve I on using green light (530 nm) a contrast potential difference of only 500V corresponds with an optical density difference of 0.5 in the original. The image-wise exposures were effected respectively with a dose of 12 mJ/m2 (blue light) and 2.5 mJ/m2 (green light).

In accordance with the above experimental evidence, the method of the present invention includes an embodiment wherein in the reversal imaging mode the image contrast is varied as a function of the wavelength of the light used in the information-wise exposure. With blue light a higher gradation is obtained than with green light.

It has to be noticed that the above mentioned contrast potential values are obtained under steady circumstances of corona charging, uniform exposures, maximal intensity of information-wise exposure, constant circumferential velocity of the photoconductor drum and fixed location of the measuring unit. Any change in these parameters will have its influence on the value of the optimal contrast potential.

By omitting the second uniform exposure (station 4) and the second corona charging (station 5) and optionally adapting the intensity of the first uniform exposure (station 1) for charge-erasure purposes, the switch from reversal image formation to positive-positive image formation is obtained without changing the toner developer.

The electrophotographic recording apparatus according to the present invention contains for the purpose of reversal image formation a movable recording element comprising a photoconductive layer on a conductive support, characterized in that said photoconductive layer during its movement is adapted to pass through the following stations in the order given :

(i) a station for uniform exposure of the photoconductive layer to light in the photosensitivity range of the photoconductive layer, which means in a range below the range wherein the differential quotient of optical density decrease (minus $\Delta D$) of the photoconductive layer with respect to wavelength increment ($\Delta\lambda$ in nm) is at least 0.02, i.e. [$-\Delta D/\Delta\lambda$(nm) =at least 0.021], (ii) a corona charging station, (iii) a station for information-wise exposure of the photoconductive layer, (iv) a station for uniform exposure of the photoconductive layer as in (i), (v) a corona charging station, and (vi) a toner developing station, and wherein the exposure stations (i) and (iv) contain an exposure device adapted to project on the photoconductive layer coloured light of wavelength longer than the wavelength of the light emitted by the station applying the information-wise exposure.

The development may be carried out with developers of the dry or wet type known in common electrophotography applying development techniques known in the art, e.g. cascade development, touch down development, magnetic brush development and electrophoretic development either or not using a development electrode.

The invention is illustrated in more details by the following examples, without restricting it thereto.

EXAMPLE 1

A photoconductive recording drum as illustrated in FIG. 1 having on an aluminium cylinder with diameter 14 cm a vacuum-coated $As_2Se_3$ photoconductive layer of 60 μm was rotated at a circumferential speed of 16 cm/s while facing the stations 1 to 6 of said FIG. 1.

Said stations were situated around the circumference of the photoconductive drum at a defined angular intervals beginning with station 1 at 0°, station 2 at 45°, station 3 at 65°, station 4 at 110°, station 5 at 120° followed by a voltage measuring probe at 150°.

At the first station the photoconductive layer was exposed uniformly with an incandescent lamp through a cut-off filter transmitting the light of said lamp above 694 nm at a dose of 1200 mJ/m2.

At stations 2 and 5 the corona charging current was kept at 150 uA operating at a corona voltage with respect to the ground of 7 kV.

At station 3 the information-wise exposure through a sensitometric wedge with density 0.1 serving as original proceeded with green (530 nm) light at a maximal exposure dose of 2.5 mJ/m2 offering a contrast potential of 900V between information-wise exposed areas and such areas that did not receive said green light. The linear part of the voltage drop curve in function of image-wise exposure dose covered 5 wedge print steps of said wedge with constant 0.1.

The obtained image was developed as a reversal image with negatively charged toner particles. When applying a magnetic brush developing technique the magnetic brush was given a bias voltage to suppress the voltage present in the unexposed areas that received no light in the information-wise exposure.

EXAMPLE 2

Example 1 was repeated with the difference however, that in the image-wise exposure blue (390 nm) light was used instead of green light.

A maximal contrast potential of 750V was obtained at a light dose of 12 mJ/m2 in the information-wise exposure. The linear part of the voltage drop curve as a function of image-wise exposure dose corresponded with only 2 wedge print steps of the sensitometric wedge with constant 0.1. Hereby proof was given that a steeper gradation image was obtained with blue light than with an image-wise green light exposure.

We claim:

1. An electrophotographic copying method for producing reversal copies from an original using a photoconductive recording material including a photoconductive layer by the steps of:

(I) uniformly exposing said photoconductive layer to light within its photosensitivity range and below the range wherein the ratio of the decrease in optical density (ΔD) of the photoconductive layer with respect to wavelength increment (Δλ in nm) is at least 0.02, (II) uniformly electrostatically charging said layer by means of a corona discharge, (III) imagewise exposing the layer corresponding to said original to light of a wavelength shorter than the wavelength of the light used in step (I), (IV) repeating step (I), (V) repeating step (II), the extent of exposure and wavelength differences of the exposing light in steps (I) and (III) being such that step (V) results in the presence in those areas of the layer which were exposed in step (III) of electrostatic charges greater than the charges present in the unexposed areas thereof in step (III), and (VI) developing the pattern of those greater charges by means of developer material comprising electrostatically charged toner particles of opposite sign to said greater charges.

2. A method according to claim 1, wherein the exposure in step (III) proceeds with light the having a wavelength at least 100 nm shorter than the wavelength of the light used in step (I).

3. A method according to claim 1, wherein the photoconductive layer is made of arsenic triselenide.

4. A method according to claim 1, wherein in step (III) the exposure proceeds with green light.

5. A method according to claim 1, wherein step (III) the exposure proceeds with blue light.

6. A method according to claim 1, wherein the photoconductive element has a fatigue characteristic that corresponds with an absolute drop in chargeability (voltage level) of at least 100V and a percental drop of at least 25%, when tested according to the following procedure: the photoconductive element is subjected to successive cycles of overall exposure and overall corona charging; the overall exposure in each cycle is an exposure to an incandescent lamp provided with a cut-off filter transmitting light above 694 nm, the exposure dose corresponding with 900 mJ/m2; the overall charging is effected by means of corona current of 6.5 uA/cm and gives at the start of each cycle a surface charge of $4.10^7$ C/cm2; and the difference between the surface charges on the photoconductive element, expressed in volts, obtained in the first and in the tenth cycle respectively is a measure of the voltage drop and consequently of the fatigue.

* * * * *